US008222505B1

(12) United States Patent
Bodnar

(10) Patent No.: US 8,222,505 B1
(45) Date of Patent: Jul. 17, 2012

(54) BOUNCING BAR FOR PLAYING STRINGED MUSICAL INSTRUMENTS

(76) Inventor: Aleksandr Bodnar, Brooklyn, NY (US)

( * ) Notice: Subject to any disclaimer, the term of this patent is extended or adjusted under 35 U.S.C. 154(b) by 0 days.

(21) Appl. No.: 13/154,784

(22) Filed: Jun. 7, 2011

(51) Int. Cl.
*G10D 3/16* (2006.01)

(52) U.S. Cl. ..... 84/320

(58) Field of Classification Search ..... 84/315–322
See application file for complete search history.

(56) References Cited

U.S. PATENT DOCUMENTS 4,969,382 A * 11/1990 Hein et al. ..... 84/319
D324,532 S * 3/1992 Pearse ..... D17/20
* cited by examiner

*Primary Examiner* — Kimberly Lockett

(57) ABSTRACT

A string bouncing bar for striking strings of a stringed musical instrument is comprised of an elongate bar body with a distal end and a proximal end. A striking head is provided at the distal end of the bar body and formed integrally therewith and of the same material as the material of the bar body. The striking head has a longitudinally extending string striking surface with the length from 0.25 to about 1.6 inches and extends along the length of the elongate bar body. A grip is provided at the proximal end of the bar body and includes a bulb portion and a generally flattened web located between and joining the bulb portion in the bar body. The web extends in a plane parallel to the plane of the striking head with the web having a thickness dimension sufficiently small to fit and to be held between adjoining fingers of a players' hand using the bar to strike the strings of the musical instrument.

21 Claims, 7 Drawing Sheets

BOUNCING BAR FOR PLAYING STRINGED MUSICAL INSTRUMENTS

BACKGROUND OF THE INVENTION

The present invention is generally directed to picked or finger plucked, stringed musical instruments and, more particularly, to a short bar usable for striking and bouncing the strings of these musical instruments to produce enhanced, more varied and richer musical tones.

Finger played musical instruments such as guitars and the like are utilized to produce musical notes and special tonal sounds using fingers, a pick or a slide. With fingers, the right hand is typically used to pluck/strum the strings of the guitar, although the same manner of playing is also possible by holding tightly between the thumb and index finger a pick to pluck the strings. The conventional slide is a hollowed cylinder into which a finger of the left hand is typically inserted and then used to slide across the strings, to produce the familiar long, pitching sound popularized by disk jockeys and others.

The prior art has thus produced the guitar sound effects and notes with methods and devices which have relied more on plucking, strumming or frictionally pulling the strings, rather than on striking them from above with a tool such as a bar or stick to set the strings to vibrate at their natural resonant harmonic frequencies. In general, the instant inventors have discovered a string bouncing tool comprising a short bar-like tool, which is sized, formed and shaped to be loosely held between an adjacent pair of fingers, to freely bounce and resonate at its distal end when used to strike the strings in a hammer like fashion, to produce multiple and richer musical tones and sounds.

U.S. Pat. No. 2,620,701 to Massey describes a rhythm stick adapted for producing single or multiple tones by striking lightly upon the strings of musical instruments such as guitars. The Massey stick has an elongated, hollow frustoconical metal baton with a long slot into which is inserted a rubber striker used to strike the strings of the musical instrument. A cylindrically shaped handle supports a proximal end of the metal baton, and the rhythm stick is used to play the guitar by cradling the handle tightly in the palm of the hand or by tightly holding it between the thumb and the index finger.

Although bearing some similarities to the bar of the present invention, the Massey stick is not designed to enhance and promote the bouncing-ability of the tool. Its weight is more concentrated toward the handle portion, and it is designed to be tightly gripped between the thumb and the index finger. Also, its construction, whereby a rubber striker is insertably held in a slot or channel of a metal body, causes more dampening of the vibration behavior of the tool, which detracts from its usefulness in the manner contemplated by the instant inventors.

Similarly, the device of the present invention differs from the familiar strikers used with dolcimers and like devices where the musical instrument is positioned in front of the players and drumstick-like devices are used with the handle end gripped by the player with the aid of the thumb, rather than solely between the fingers, with the body extending out above and away from the hand.

SUMMARY OF THE INVENTION

Accordingly, it is an object of the present invention to provide a bar-like tool which is useable to play the strings of a guitar and the like to produce tones and sounds some of which differ from those produced when playing the strings with picks and fingers.

It is another object of the present invention to provide a string playing tool having a unitary, integral body, made of a homogenous material and with a holding end which is constructed to be held between adjacent fingers.

Yet another object of the invention is to provide a strings playing tool, the holding end of which allows it to easily pivot or move between the holding fingers to enhance and improve its bouncing characteristics on the string hammering end thereof.

The foregoing and other objects of the invention are realized with a string bouncing bar for striking strings of a stringed musical instrument which is essentially formed as an elongate solid bar body, having a distal end and a proximal end, with a striking head and a hand grip. The striking head is at the distal end of the bar body and formed integrally and of the same material as the bar body. The striking head has a longitudinally extending string striking surface with a length of from 0.25 to 1.6 inches.

The hand grip is formed of a bulb portion and a generally flattened web which is located between and joins the bulb portion to the bar body. The web extends in the same plane or in a plane parallel to the plane of the striking head. The thickness dimension of the web is sufficiently small so as to fit and/or move between a pair of adjacent fingers, with the grip held below the fingers and the bar body extending away from the top of the hand.

Preferably, the bar has a weight distribution which makes it heavier toward the distal end thereof, the weight gradually increasing toward the distal end. Preferably, the bar is formed of one material which can be any one of a ceramic, plastic, metal, wood, or like materials.

Preferably, on a side of the bar body which is located oppositely to the side supporting the striking head, there is provided a longitudinally extending, multi-string striking edge which has a length greater than 1.6 inches and which is usable for striking several strings simultaneously, or even all of them.

In accordance with another preferred feature, a sliding surface is defined on the bar body, preferably on the same side as the striking head. The sliding surface has a curved shape so that it can be slid across the strings to produce the familiar sound effect obtained by "sliding" over the strings.

Other features and advantages of the present invention will become apparent from the following description of the invention which refers to the accompanying drawings.

DETAILED DESCRIPTION OF EMBODIMENTS OF THE INVENTION

Figure 1:
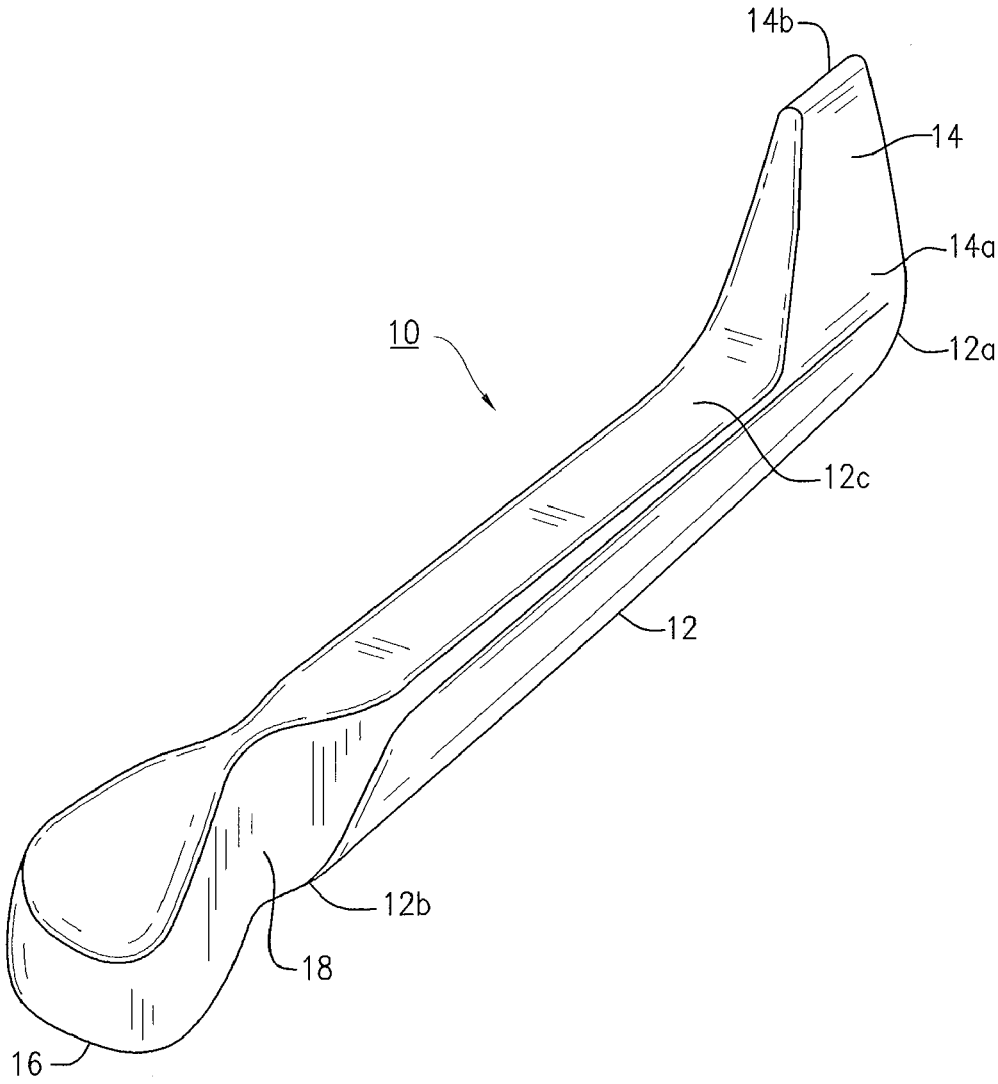
FIG. 1 is a perspective of the strings striking bar tool in accordance with an embodiment of the present invention.

Referring to FIG. 1, the space bar or tool 10 comprises a central bar or tool body 12 with a strings striking head 14 at a distal end 12*a* thereof, a bulbous grip 16 at a proximal end 12*b* of the bar body 12 and a narrowed neck or holding web piece 18. The web 18 joins the bar body 12 to the grip 16 and also forms a narrowed portion which is sized and configured to fit between the index finger 22 and the middle phalange 24 of the player (see FIG. 7), although some players might prefer to hold the tool 10 between other pairs of adjacent fingers.

Figure 4:
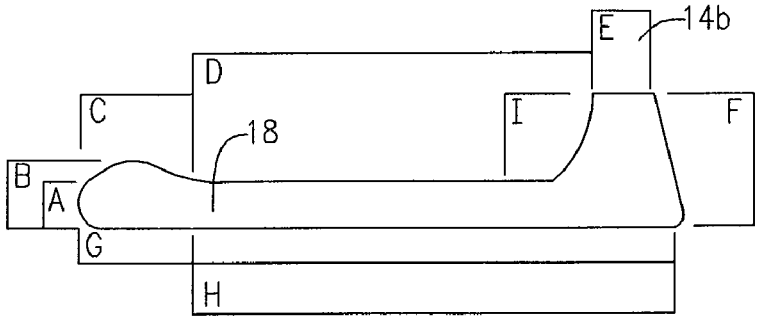
FIG. 4 is a side view of the tool of FIG. 1, annotated with dimensional markings to convey the relative dimensional sizes of different parts of the tool.
Figure 4A:
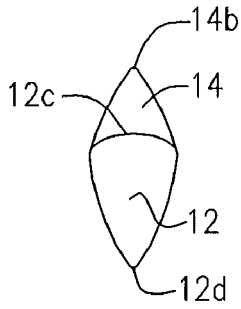
FIG. 4A is a cross-section through the bar body of the tool of FIG. 1.

As shown in FIG. 4A, the bar body 12 has a generally pear or triangular cross-sectional shape, with a rounded (curved) bottom surface 12*c* (which faces toward the musical instrument) and a more triangular, or cross-sectionally narrowing shape, culminating in a long string striking edge 12*d*. However, the body 12 may have any cross sectional shape without loosing it suitability for performing its functions herein.

The striking head 14 is located at the distal end 12*a* of the bar body 12, and generally extends away from the striking side 13 and sliding surface 12*c* of the bar body 12, with the base 14*a* thereof being larger in cross-sectional size or width and tapering down in size in a direction away from the bar body 12, terminating in the elongate, longitudinally extending string striking edge 14*b*, which is designed and configured to strike and bounce as it hammers a single string or two adjacent strings of the musical instrument, typically a guitar. Since acoustic, electric and bass instruments have differently spaced strings, the length of the striking surface or edge 14*b* is preferably about 9/16 inches, although it can range in size from 4/16 to 1.6 inches, and is preferably in the range of 7/16 to 1 inches. The striking surface 14*b* may be "edge" shaped and have a width in the range of close to zero to 10/16 inches, preferably 1/16 to 6/16 inches, and a preferred width of about 1.5/16 inches. The striking surface 14*b* may be flat, but is preferably slightly curved to avoid cutting or damaging the strings of the guitar.

As shown in FIG. 4, the edge 14*b*, the body of the head 14 and the center of the bar body 12 lie in a common plane (in the plane of the paper), which also includes the web 18 (although the plane of web 18 may be slightly offset away from the mentioned plane, while remaining parallel thereto). Thereby, holding web 18 between two fingers orients the edge 14B perpendicular to the string running direction.

Figure 7:
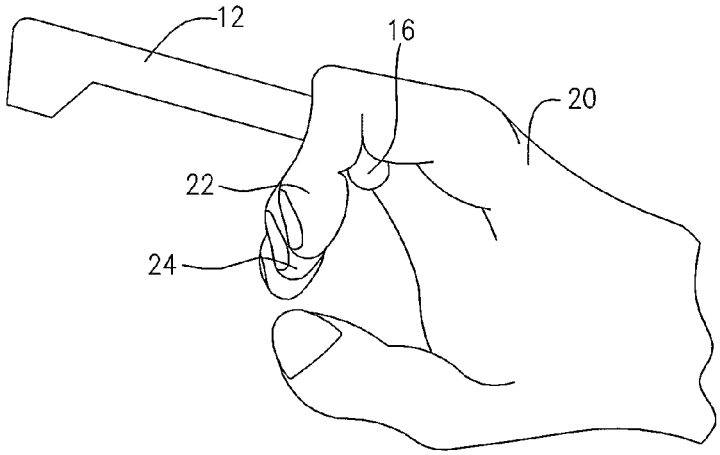
FIG. 7 and FIGS. 7A-7E show manners of holding the tool of FIG. 1.
Figure 7B:
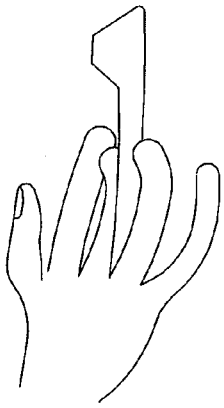
Figure 7A:
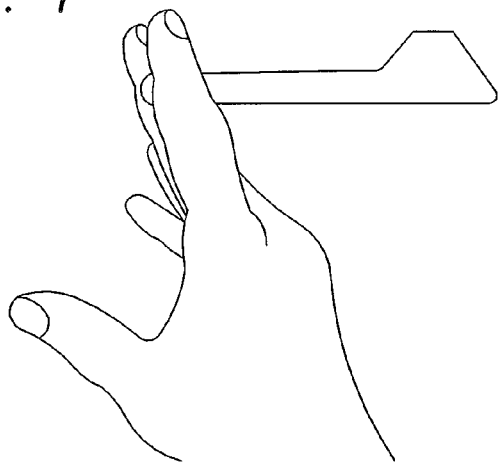
Figure 7E:
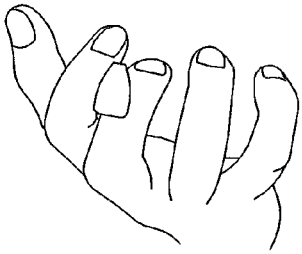
Figure 7D:
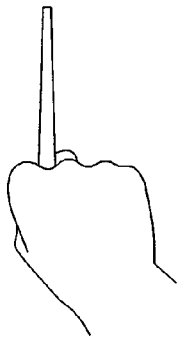
Figure 7C:
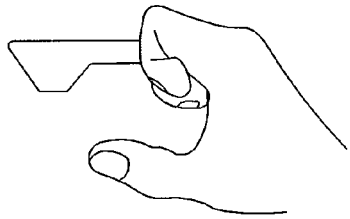

As shown in FIG. 7, the bulb or grip 16 is designed to be is held below the fingers 22, 24 with the web 18 held between the fingers and the bar body 12 extending away from the hand 20. When a string (not shown) is struck, the bar 10 is free to pivot at or move or waver between the fingers and so bounce on the string at its natural vibration modes which are determined by the bar's material, length, weight, frictional force at the fingers, and the string tension, etc. The playing effects are quite different from those that are obtained when the tool 10 is firmly grasped with the thumb, which then interferes with and/or more strongly dampens the bouncing effects of the tool. Similar or other holding modes are shown in FIGS. 7A to 7E. In particular, FIG. 7B shows a holding mode for the sliding use of the tool.

Figure 3:
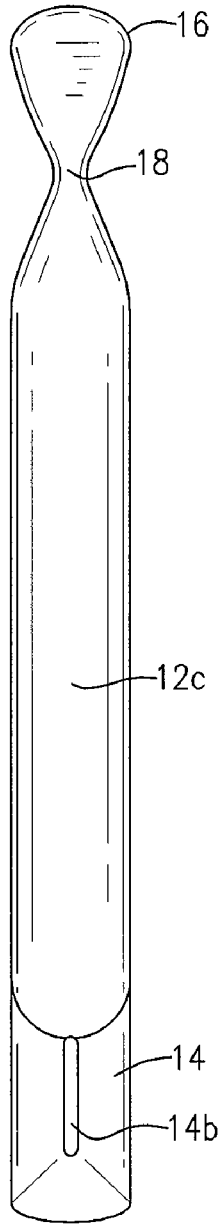
FIG. 3 is a bottom side view of the tool of FIG. 1.

As can be seen in FIG. 3, the spatial orientation of the web 18 is such that, were it to be held between the thumb and index finger, the head 14 would be turned 90 degrees away from the orientation needed to strike the strings. In other words, the shape and orientation of the web 18, naturally aligns the striking surface 14*b* to strike the strings vertically, with the edge extending perpendicularly to the strings.

Figure 2:
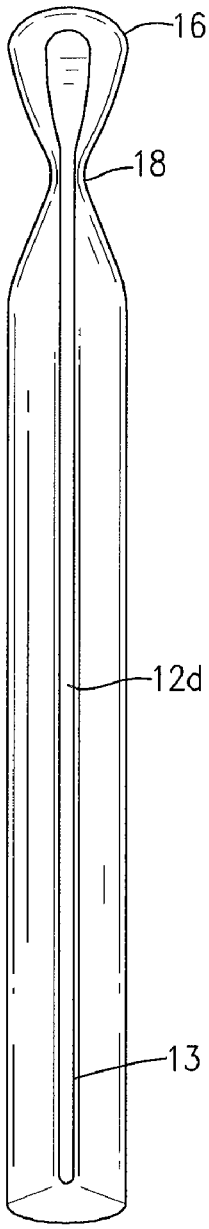
FIG. 2 is a top side view of the tool of FIG. 1.
Figure 6:
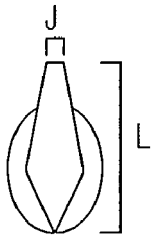
FIG. 6 is a tip end view of the tool of FIG. 1.

As further seen in the figures (FIGS. 2, 4A and 6), the top side of the bar body 12 has a more triangular shape with the edge 12*d* of the triangular defining the multi-string striking surface 13. In contrast, the bottom side of the bar body 12 has a more circular or near circular surface 12C, as to mimic the shape of a sliding tool. Preferably, the radius of curvature of the sliding surface 12C is constant with a preferred radius of about 7/16 inches, or a radius in the preferred range of 4/16 to one inch, or in the maximum range of from 2/16 to 2 inches. When using the tool of the present invention as a sliding tool, with sliding surface 12C facing the strings of the musical instrument in order to produce sliding tones, the tool can be held in the opposite hand of the strumming hand, with the top side 13 resting between two adjacent fingers, edge 12D comfortably filling the crevasses between the adjacent fingers, acting as a grip for additional control of the tool for the purposes of obtaining sliding tones. Web 18 can sit in between the bottom phalange of said adjacent fingers. See FIG. 7B.

Various dimensional relationships between the bar body, the striking head and the grip are set forth below by way of non-limiting examples. In general, the overall length of the bouncing bar 10 is designed to allow it to be easily and comfortably be held between adjacent fingers, while striking the strings of a guitar or like instrument without losing accuracy or impacting playing consistency. Similarly, the overall weight of the tool is optimized to create optimal bouncing effects with the weight concentrated toward the striking head.

With reference to FIG. 4, where the lowercase letters "a" through "i" designate different dimensions, as indicated, the chart below provides for each dimension, a preferred dimension, a maximum range variation, and a preferred optimal range, all in inches.

| Dimension | A | B | C | D | E | F | G | H | I |
|---|---|---|---|---|---|---|---|---|---|
| Preferred | 7/16 | 10/16 | 14/16 | 3 15/16 | 9/16 | 1 3/16 | 5 6/16 | 4 8/16 | 12/16 |
| Optional | 5/16 | 7/16 | 8/16 | 4 1/16 | 7/16 | 1 | 5 | 4 8/16 | 11/16 |
| Range | to | to | to | to | to | to | to | to | to |
| | 12/16 | 12/16 | 1 3/16 | 4 8/16 | 1 | 1 5/16 | 6 11/16 | 5 8/16 | 9/16 |
| Maximum | 3/16 | 5/16 | 7/16 | 2 13/16 | 4/16 | 8/16 | 3 8/16 | 3 1/16 | 5/16 |
| Range | to | to | to | to | to | to | to | to | to |
| | 1 | 1 | 1 11/16 | 4 13/16 | 1 10/16 | 2 8/16 | 7 8/16 | 5 13/16 | 1 8/16 |

Figure 5:
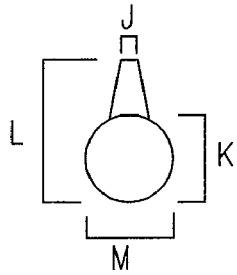
FIG. 5 is a grip end view of the tool of FIG. 1.

The corresponding dimensions j, k, l, m of FIG. 5 are set forth in the table below.

| Dimension | J | K | L | M |
|---|---|---|---|---|
| Preferred | 1 5/16 | 10/16 | 1 3/16 | 7/16 |
| Optional Range | 7/16 to 6/16 | 1/16 to 12/16 | 1 to 1 5/16 | 5/16 to 10/16 |
| Maximum Range | 0 to 10/16 | 5/16 to 1 | .5 to 2.5 | 3/16 to 1 |

Figure 8A:
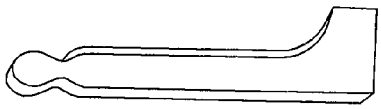
FIGS. 8A through 8K illustrate various other embodiments of the basic tool of FIG. 1.
Figure 8B:
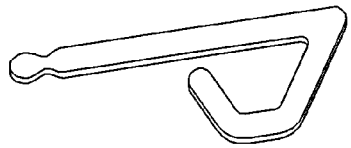

Referring to FIGS. 8A through 8K, the embodiment of FIG. 8A shows an implementation where the web portion is oriented to be held between the thumb and the index finger. In other words, the orientation of the connecting web 18*a* is at 90° as compared to the one previously described. In FIG. 8B, the striking head is formed as a re-entrantly bent portion of the body itself.

Figure 8C:
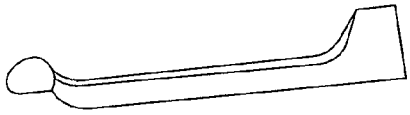

In FIG. 8C, the grip 16*a* is offset as shown.

Figure 8D:
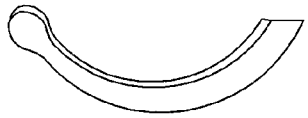

In FIG. 8D, the body of the bar 12 is arcuate with the grip portion and the single string striking surface being at about the same height.

Figure 8E:
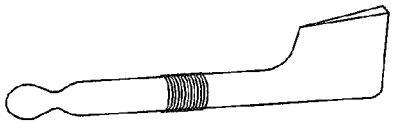

In FIG. 8E, a rubber or spring material connective portion is provided in the midst of the bar body to enhance bouncability.

Figure 8F:
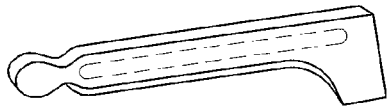

In FIG. 8F, the body of the bar is hollowed to generally reduce the overall weight of the tool.

Figure 8G:
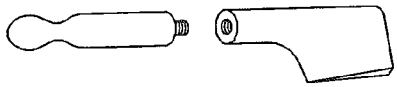

In FIG. 8G, the body 12 is formed of two parts which can be screwed together as shown. This embodiment also allows the two components to be made of different materials; for example, glass and metal, etc.

Figure 8H:
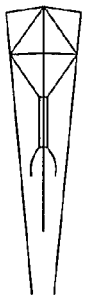

FIG. 8H shows a multi-sided version of the tool of the present invention.

Figure 8I:
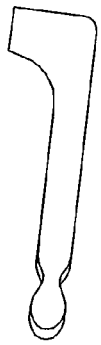

FIG. 8I shows an indent for a finger rest which helps in holding in the left hand, for slide playing.

Figure 8J:
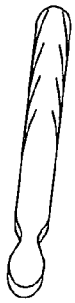

In FIG. 8J, the tool is provided without its aforementioned head and is usable for multi-string strikes or slicing in the left hand.

Figure 8K:
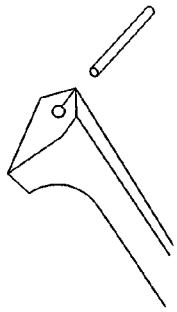

In FIG. 8K, a longitudinally extending orifice allows insertion of a weighing rod. Extra weight can be added by inserting a weighted rod or by inserting into the head of the device, to create greater bouncability.

Figure 9A:
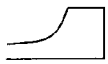
FIGS. 9A through 9P and 9R through 9S show different shapes of the single and multiple string striking surfaces.
Figure 9B:
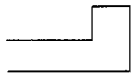
Figure 9C:
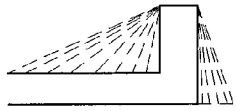
Figure 9D:
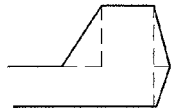
Figure 9E:
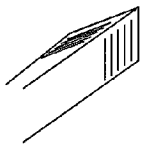
Figure 9F:
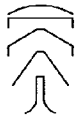
Figure 9G:
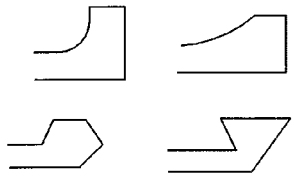
Figure 9H:
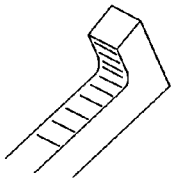
Figure 9I:
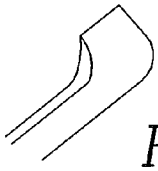
Figure 9J:
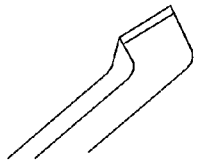
Figure 9K:
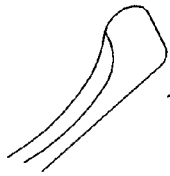
Figure 9L:
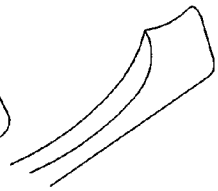
Figure 9M:
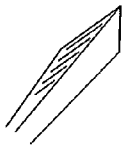
Figure 9N:
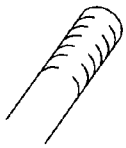
Figure 9O:
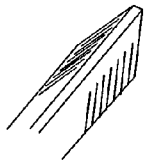
Figure 9P:
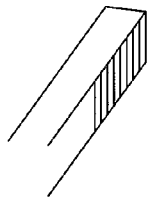
Figure 9R:
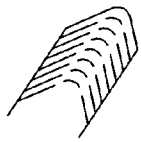
Figure 10A:
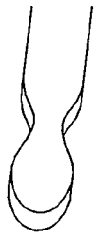
FIGS. 10A through 10H show several variations of the gripping end.
Figure 10B:
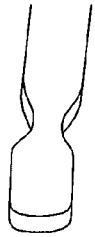
Figure 10C:
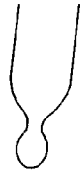
Figure 10D:
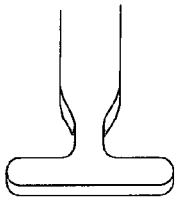
Figure 10E:
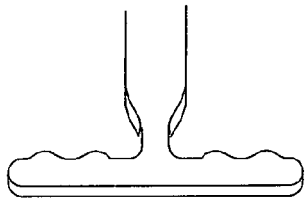
Figure 10F:
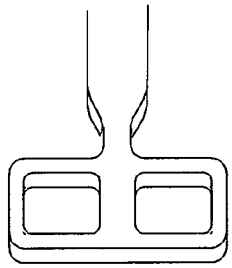
Figure 10G:
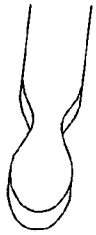
Figure 10H:
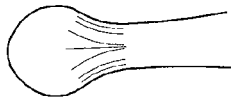
Figure 9S:
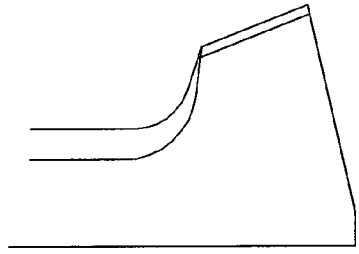

FIGS. 9A through 9S, show different shapes of the single or multiple string striking surfaces. For example, in FIG. 9H, the striking edge is actually a square surface which slopes down toward the grip. In FIG. 9K, the edge is convex, whereas in FIG. 9L it is concave.

FIGS. 10A through 10H show several variations of the gripping end. For example, in FIG. 10E, the grip is shaped to match the spacing and shape of the fingers.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A string bouncing bar for striking strings of a stringed musical instrument, comprising:

an elongate bar body having a distal end and a proximal end;

a striking head at the distal end of the bar body and formed integrally and of the same material as a material of said bar body, said striking head having a longitudinally extending string striking surface with a length of 0.25 to 1.6 inches, said striking head and its striking surface extending generally along a plane; and a grip located at the proximal end of the bar body and including a bulb portion and a generally flattened web located between and joining the bulb portion and the bar body, said web extending in plane parallel to the plane of the striking head, said web having a thickness dimension sufficiently small to fit and be held between adjoining fingers of a player's hand using the bar to strike the strings of the musical instrument.

2. The string bouncing bar of claim 1, in which said bar has a weight distribution such that, relative to a longitudinal midpoint of said bar, more of the weight of the bar is located toward the distal end thereof.

3. The string bouncing bar of claim 2, wherein a cross sectional weight of the bar gradually increases along said bar body, in a direction toward said distal end.

4. The string bouncing bar of claim 1, wherein said bar is solid and formed of a single material selected from the group of ceramic, plastic, metal and wood materials.

5. The string bouncing bar of claim 1, wherein said bar has a weight in the range of from 0.4 to 2.2 ounces.

6. The string bouncing bar of claim 1, said bar including a longitudinally extending, multi-string striking surface provided away from said striking head.

7. The string bouncing bar of claim 6, wherein said length of said multi-string striking surface is greater than 3.5 inches.

8. The string bouncing bar of claim 6, wherein said multi-string striking surface is located diametrically opposite to said striking surface of said striking head, relative to said bar body.

9. The string bouncing bar of claim 1, further including a sliding surface defined on said bar body and formed thereon in a configuration that enables sliding of said sliding surface on said strings of said musical instruments while the bar is held at said grip.

10. The string bouncing bar of claim 9, where said bar body has a striking side and an opposed bottom side, and wherein said sliding surface and said striking head are located at the said bottom side of said bar.

11. The string bouncing bar of claim 10, including a multi-string striking surface located on said top side of said bar.

12. The string bouncing bar of claim 9, wherein said sliding surface has a curved cross sectional shape.

13. The string bouncing bar of claim 12, wherein said curved cross sectional shape has a constant curvature.

14. The string bouncing bar of claim 1, wherein said bar body has a length dimension between said grip and said striking head of from $2\frac{7}{16}$ to $4\frac{15}{16}$ inches.

15. The string bouncing bar of claim 1, wherein said striking head has a base with a 2-dimensional width which gradually decreases toward said striking surface, and said striking surface being generally elongate and edge shaped.

16. The string bouncing bar of claim 6, wherein said multi-string striking surface is edge shaped.

17. The string bouncing bar of claim 1, wherein said string bar has dimensions identified by the letters A, B, C, D, E, F, G, H, I, J, K, L, M which respectively have the inches range of: $\frac{3}{16}$ to 1; $\frac{5}{16}$ to 1; $\frac{7}{16}$ to $1\frac{11}{16}$; $2\frac{13}{16}$ to $4\frac{13}{16}$; $\frac{4}{16}$ to $1\frac{10}{16}$; $\frac{8}{16}$ to $2\frac{8}{16}$; $3\frac{8}{16}$ to $7\frac{8}{16}$; $3\frac{1}{16}$ to $5\frac{13}{16}$; $\frac{5}{16}$ to $1\frac{8}{16}$; 0 to $\frac{10}{16}$; $\frac{5}{16}$ to 1; 0.5 to 2.5 and $\frac{3}{16}$ to 1.

18. The string bouncing bar of claim 1, wherein said string bar has dimensions identified by the letters A, B, C, D, E, F, G, H, I, J, K, L, M which respectively have the inches range of: $\frac{5}{16}$ to $\frac{12}{16}$; $\frac{7}{16}$ to $\frac{12}{16}$; $\frac{8}{16}$ to $1\frac{3}{16}$; $4\frac{1}{16}$ to $4\frac{8}{16}$; $\frac{7}{16}$ to 1; 1 to $1\frac{5}{16}$; 5 to $6\frac{11}{16}$; $4\frac{8}{16}$ to $5\frac{8}{16}$; $\frac{11}{16}$ to $\frac{9}{16}$; $\frac{1}{16}$ to $\frac{6}{16}$; $\frac{7}{16}$ to $\frac{12}{16}$; 1 to $1\frac{5}{16}$ and $\frac{5}{16}$ to $\frac{10}{16}$.

19. The string bouncing bar of claim 1, wherein said string bar has dimensions identified by the letters A, B, C, D, E, F, G, H, I, J, K, L, M which respectively have the inches value of about: 7/16; 10/16; 14/16; 3 15/16; 9/16; 1 3/16; 5 5/16; 4 8/16; 12/16; 1 5/16; 10/16; 1 3/16; and 7/16.

20. A method of playing a stringed musical instrument having a plurality of strings, to produce sliding tones therefrom, the method comprising the steps of:

providing a sliding tool having an elongated bar body with a sliding surface defined thereon;

using one hand of a player to strum the strings of the musical instrument;

using the other hand of the player to hold the sliding tool with the sliding surface facing the strings while the bar body is supported between two adjacent fingers and sliding the tool on the strings to produce said sliding tones.

21. The method of playing a stringed musical instrument of claim 20, wherein said sliding tool further including a bulb portion and a generally flattened web located between and joining the bulb portion and bar body.

* * * * *